United States Patent [19]

Molitor et al.

[11] Patent Number: 4,907,372

[45] Date of Patent: Mar. 13, 1990

[54] CYLINDER BORE FINISHING APPARATUS TILT FIXTURE

[75] Inventors: Gerald R. Molitor, Holland; Richard G. Bidigare, Hamilton, both of Mich.

[73] Assignee: Micromatic Operations Inc., Holland, Mich.

[21] Appl. No.: 112,731

[22] Filed: Oct. 26, 1987

[51] Int. Cl.[4] ..... B24B 5/08

[52] U.S. Cl. ..... 51/38; 51/34 R

[58] Field of Search ..... 51/38, 35, 46, 216 A, 51/217 A, 227 R, 34 R, 34 D

[56] References Cited

U.S. PATENT DOCUMENTS

| | | | |
|---|---|---|---|
| 1,933,149 | 10/1933 | Poole | 51/216 ND |
| 2,738,625 | 3/1956 | Strnad | 51/216 A |
| 3,032,932 | 5/1962 | Bargren | 51/34 R |
| 3,380,197 | 4/1968 | Fitzpatrick | 51/34 R |
| 4,187,644 | 2/1980 | Fitzpatrick | 51/34 D |
| 4,423,567 | 1/1984 | Raven, III | 51/34 R |

*Primary Examiner*—Robert Rose

*Attorney, Agent, or Firm*—John C. Evans

[57] ABSTRACT

A finishing apparatus includes an upright frame mounted finishing head driven by a hydraulic cylinder controlled by a proportional valve or a servo drive which ball screw under the control of a central processor unit in accordance with the type of an engine block being finished. The different types of engine blocks are oriented to have the cylinder bores thereof finished by common finishing tool(s) mounted on the head. The apparatus includes a linear positioning element, either in the form of an expandable collet or in the form of a fixed diameter mandrel, which is selectively engageable with the block at the crankshaft bores thereof to locate the block with respect to the finishing tools, and a rotating mechanism is included to tilt the block in accordance with the type of block being processed so as to vertically align the cylinder bores of either in-line or V types of enging blocks with the finishing tool(s).

25 Claims, 7 Drawing Sheets

FIG 5
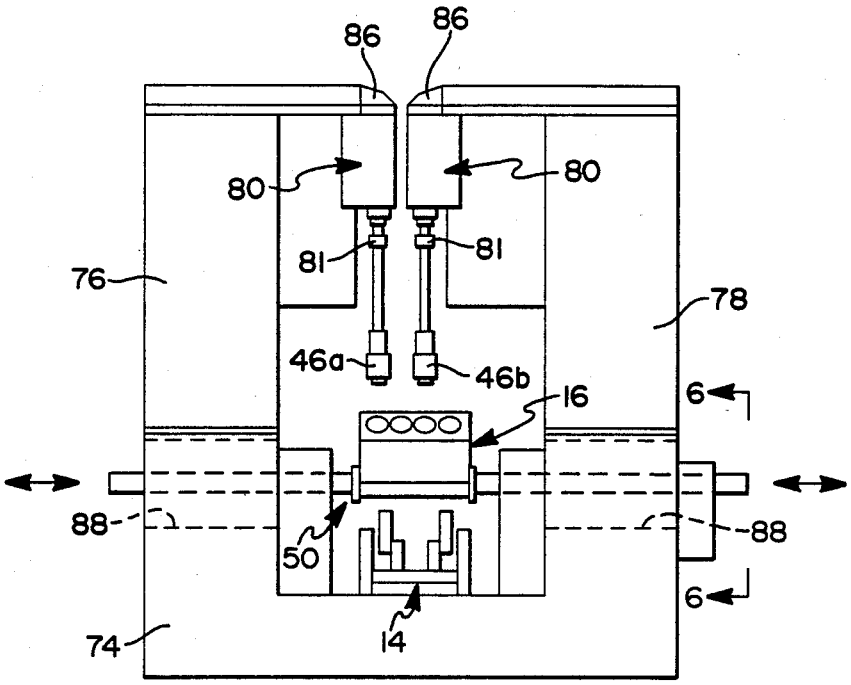
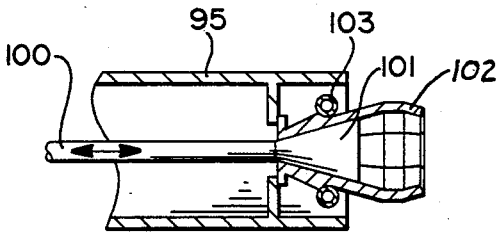
FIG 9

CYLINDER BORE FINISHING APPARATUS TILT FIXTURE

BACKGROUND OF THE INVENTION

This invention relates to finishing apparatus and more particularly to finishing apparatus having fixtures for turning a workpiece to align the work piece with respect to finishing tools during a programmed sequence of operations.

Engine block transfer systems have been used in association with spaced finishing stations. Blocks are moved sequentially with respect to selected ones of the spaced finishing stations. Different finishing operations are performed on cylinder bores in the engine block at each of such stations.

For purposes of definition "finishing" refers to cylinder bore stock removal by either a honing operation in which a honing tool is reciprocated, rotated and expanded with respect to a cylinder bore; or by a single pass abrasion operation in which an abrasive element of fixed diameter is reciprocated and rotated with respect to a cylinder bore.

In order to increase the flexibility of such transfer and finishing operations, it is desirable to be able to perform the same kind of finishing on a family of engine block types including in-line cylinder blocks and various forms of V-block configurations which are transferred by lift and carry type transfer mechanisms to prevent wear of aluminum or other light metal blocks.

Different types of engine blocks require a different fixture setup on the transfer line to properly align the cylinder bores with a given finishing apparatus. For example, an upright frame type finishing apparatus with substantially vertically oriented finishing tools has fixtures that position V blocks so that the cylinder bores in each bank of the V block are disposed in attitudes to permit entry of the finishing tool. Such fixtures are not adaptable to in-line cylinder block types.

DESCRIPTION OF THE PRIOR ART

U.S. Pat. No. 2,408,231, issued Sept. 24, 1946, discloses a power driven or manually rotatable work holding unit which has a tilt table for positioning a workpiece. The apparatus is configured to accept only a single workpiece and corresponds to special tooling of the type used on prior transfer systems. It is not designed nor will it function to work in conjunction with a block lift and transfer system which moves a plurality of block types with respect to a plurality of separate finishing units each of which is capable of performing a different finishing operation on a cylinder bore.

U.S. Pat. No. 3,796,011, issued Mar. 12, 1974, discloses a combination machining and part turnover apparatus which presents different: surfaces to a cutting tool. It does not suggest an arrangement having a common transfer line and common fixturing for aligning and positioning both straight engine blocks and V-engine blocks with respect to finishing apparatus which is operative to perform a sequence of finishing steps on cylinder bores in the different types of blocks.

U.S. Pat. No. 3,821,867, issued July 2, 1974, discloses apparatus for positioning rotary engine blocks for machining internal surfaces thereof. It is a special machine that does not suggest how to perform a sequence of finishing operations on both in-line and V engine blocks.

U.S. Pat. No. 4,207,710, issued June 17, 1980, discloses a workpiece positioning apparatus for holding a workpiece relative to a rotating drive spindle of a grinder. The apparatus only suggests the rotation of a workpiece with respect to the drive spindle to position surfaces on the workpiece with respect to a grinding wheel.

SUMMARY OF THE INVENTION

A feature of the present invention is the provision of a finishing apparatus with universal fixturing that will accommodate both in-line engine block and V engine block configurations to carry out different finishing operations on both types of engine blocks. The finishing apparatus includes an upright frame mounted finishing head with a hydraulic cylinder drive or a servo drive with a ball screw. The drive is under the control of a central processor unit programmed to control the drive in accordance with the type of an engine block unit being processed. The universal fixturing includes a linear positioning element such as an expandable collet or a fixed diameter mandrel which is selectively engageable with the block at the crankcase bores thereof to locate the block with respect to the finishing tools. The universal fixturing further includes a rotating mechanism. It tilts a block in accordance with the type of block being processed so as to vertically align the cylinder bores of either in-line or V block types of engine blocks with the finishing tool(s).

A further feature of the present invention is to improve and simplify the finishing of engine block cylinders in a variety of engine blocks including both in-line and V types wherein the blocks are carried to individual finishing stations by a lift and carry transfer mechanism and oriented with respect to the finishing tools and by providing universal fixturing means that permit a flexible scheduling of block types without requiring the resetting of associated fixturing.

Still another feature of the present invention is to provide such universal fixturing in cylinder block finishing apparatus having a finishing tool and controls for operating a spindle drive to selectively position a finishing tool and operate it within a cylinder bore to remove predetermined stock from the cylinder bore, and wherein the universal fixturing includes a linear locator means for positioning each of a plurality of engine block types into alignment with the finishing tools; and wherein the universal fixturing further includes rotating means for selectively tilting the engine block types in accordance with the engine block type aligned with the finishing tools.

BRIEF DESCRIPTION OF DRAWINGS

Other advantages of the present invention will be readily appreciated as the same becomes better understood by reference to the following detailed description when considered in connection with the accompanying drawings wherein:

FIG. 5 is an end elevational view of a cylinder bore finishing station viewed from line 5—5 of FIG. 1 looking in the direction of the arrows;

FIG. 9 is a fragmentary sectional view of an expanding collet;

DESCRIPTION OF PREFERRED EMBODIMENT

Figure 1:
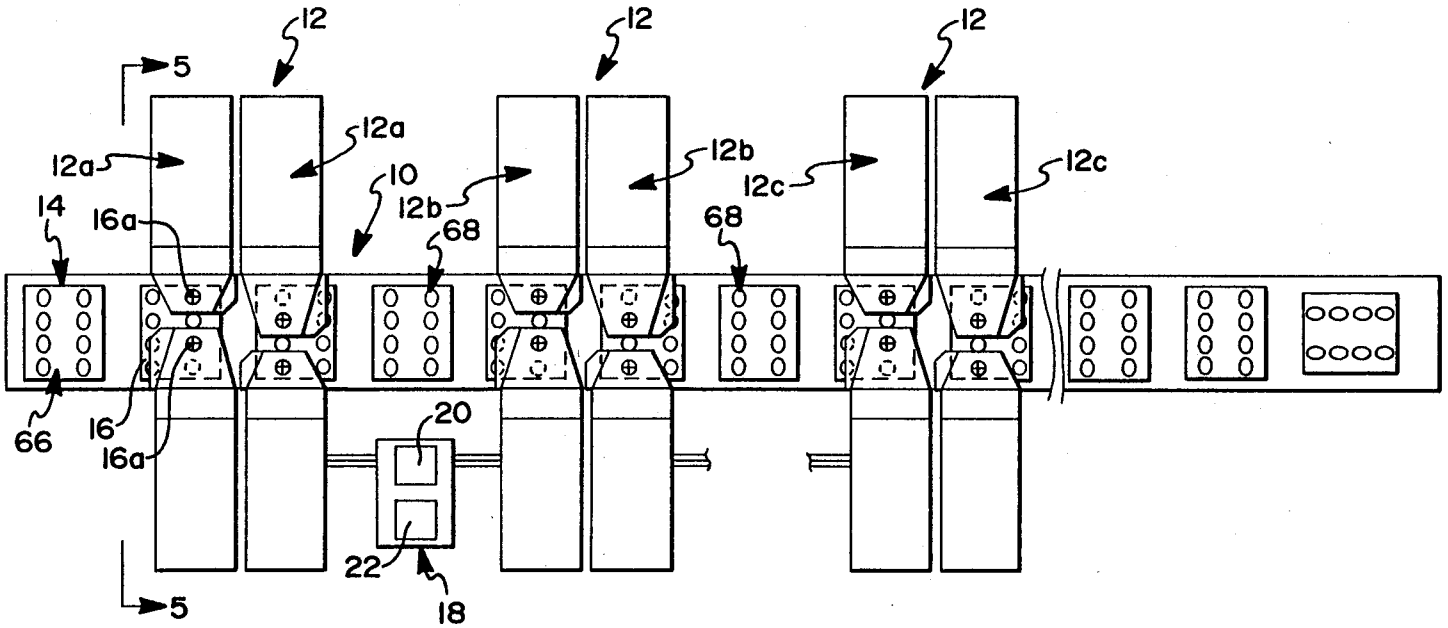
FIG. 1 is a diagrammatic view of a cylinder bore finishing line including the present invention.

FIG. 1 shows a representatively illustrated cylinder bore finishing line 10 having a plurality of spaced finishing stations 12 for cylinder bores including fixed diameter abrasive finishing at station 12*a* and honing at stations 12*b*, 12*c*. An engine block lift and carry transfer line 14 is diagrammatically shown in FIG. 2. It supplies and positions cylinder blocks 16 with respect to preselected ones of the finishing stations 12, 12*a* under the control of a machine control 18 which includes a hone control 20 shown in FIG. 3 and a fixed abrasion tool control shown in FIG. 4.

Input data for honing is directed from a crt board 24 by data bus 26 to input and store programs for operating the lift and carry transfer line 14 and the individual finishing stations 12 in accordance with the type of blocks 16 being processed by the finishing line 10.

A programmable controller 28 is connected to the crt board 24 by a video bus 29 to display control information and by bus 26 to input data into programmer 28. The machine control 18 for operating the lift and carry mechanism may be controlled by signals from programmer 28 via bus 31.

A cpu (central processor unit) board 30 receives data from a bus 32 that carries signals to and from a fixture control 33 for controlling positioning of cylinder blocks 16 by a linear locator 50.

During honing control by control 20 at stations 12*b*, 12*c*, the top and bottom stroke of the honing stroke drive is monitored by an encoder 34 having a rack 34*a* coupled to the reciprocating drive. Encoder 34 directs signals to an electronic stroke control unit 35 via bus 36.

The programmable controller 28 provides an output signal via bus 38 to a spindle motor control 40. A drive and stroking system 42 at each honing station 12*b*, 12*c* has a drive shown illustratively as a hydraulic stroke cylinder 44 to which the finishing tool 46 is attached. The direction of movement of cylinder 44 is controlled by a hydraulic proportional valve 45 which is positioned by command signals from cpu 30 via bus 47.

Honing head spindle motor control 40 and the stroke control combine to produce a desired honing operation for removing predetermined stock from the wall of a cylinder bore. Suitable means (not shown) provide for incremental adjustment of the expansion of the diameter of a honing tool if the finishing step is one in which tool diameter adjustment is used to bring a cylinder to a consistent size.

Figure 4:
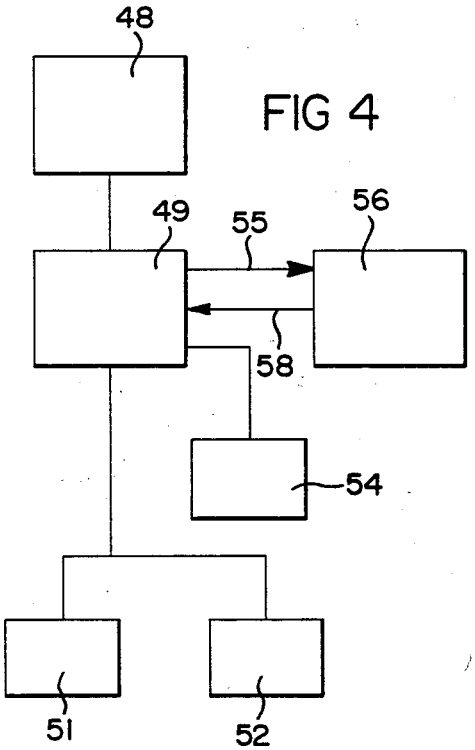
FIG. 4 is a schematic view of a control system for controlling fixed diameter abrasion operations.

The fixed diameter abrasion control 22, diagrammatically shown in FIG. 4, includes a crt board 48; a programmable controller 49; a tool size selector 51 and a spindle load selector 52 as well as a start-stop control 54. When the programmable controller 49 is properly inputted, it will direct command signals via bus 55 to a servo drive ball unit 56. The servo drive has an encoder for producing a feed back signal of drive position via bus 58. The start stroke and bottom of stroke of the servo drive 56 is detected by suitable limit switches or encoder (not shown).

Figure 2:
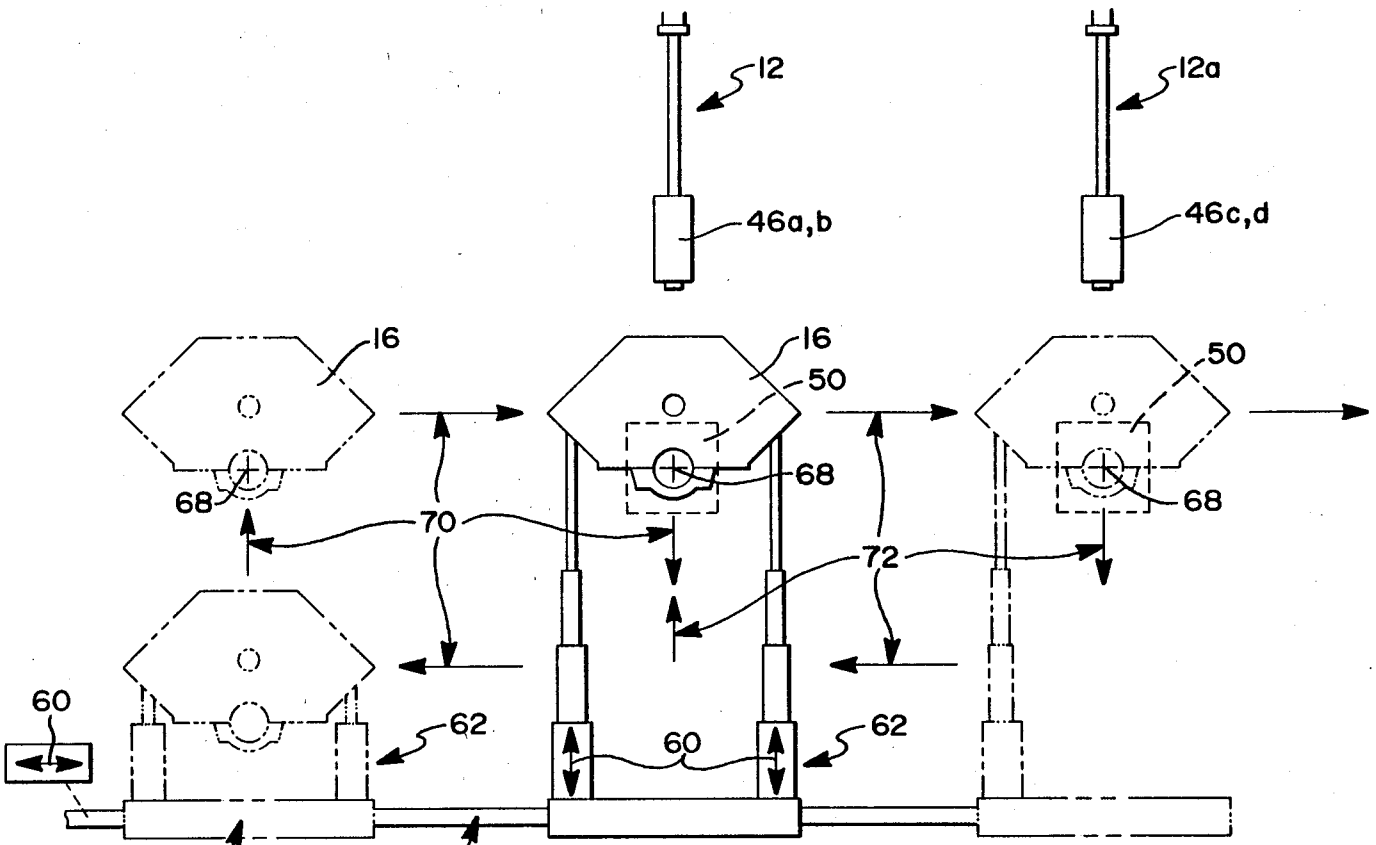
FIG. 2 is a diagrammatic view of a lift and carry transfer system used in association with the present invention.
Figure 3:
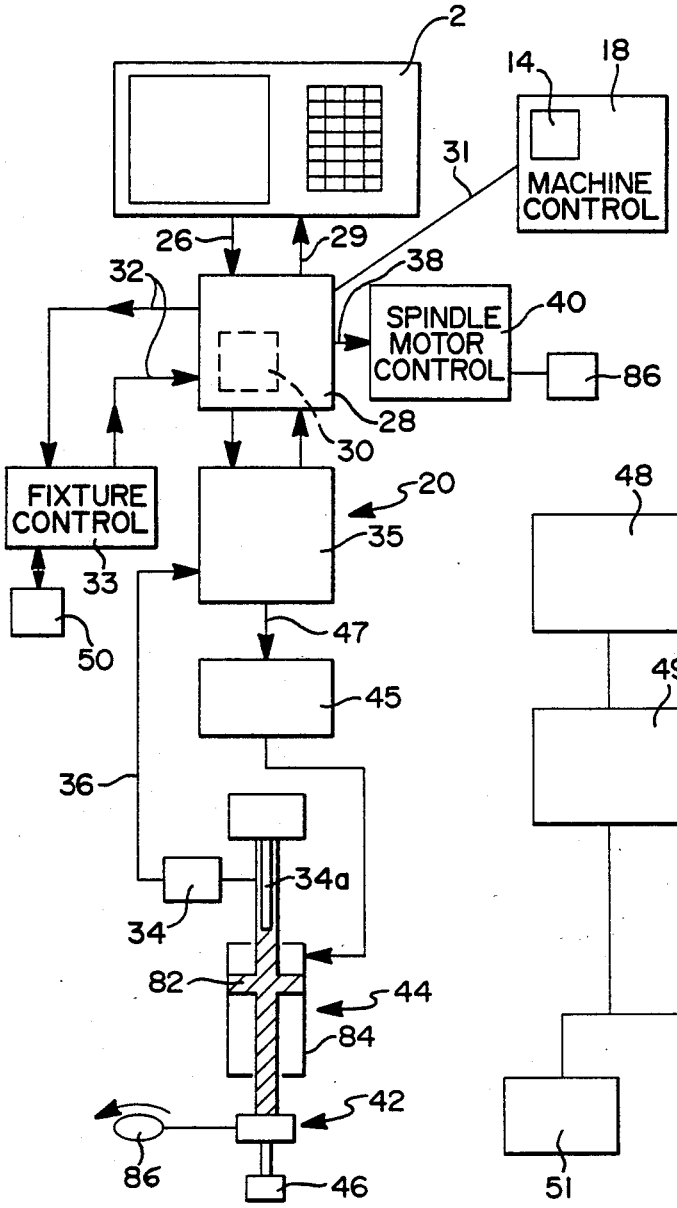
FIG. 3 is a schematic view of a control system for controlling variable diameter honing operations.

The lift and carry transfer line 14 includes drive components 60 (either hydraulic cylinders or electric motor driven ball screws) for advancing the line 14 along the flow path 70 shown in FIG. 2.

The line 14 has a lift mechanism 62 and a carry mechanism 64. The drive motor 60, and lift mechanism operate to transport the blocks 16 from load station 66 so as to align their crankshaft bore axes 68 with respect to the linear locator 50. Following a finishing operation, the lift mechanism 62 is retracted and the carry mechanism 64 is returned to its start position. Suitable idle stations 68 are provided along the line intermediate the finishing stations. The block 16 is advanced by lift mechanism 62 and carry mechanism 64 at downstream stations having a path such as sequence 72 for carrying out a desired sequence of machine operations.

In the illustrated embodiment of the invention, each of the finishing stations 12, as shown in FIG. 5, more particularly includes a base 74 and pair of spaced upright frames 76, 78. Each of the upright frames 76, 78 has a spindle head 80 which rotates and reciprocates the finishing tool 46 connected thereto by an adapter flange 81.

A suitable source of hydraulic fluid is adapted to be supplied to the cylinder 44 in the usual manner to cause vertical reciprocation of a quill or piston 82 with respect to a hydraulic cylinder 84. A drive motor and pulley system 86 connects to the spindle cylinder o rotate the tool 46 during the stroke movement.

The finishing tool 46 is thereby reciprocated and rotated into and out of selected cylinder bores 16*a* of blocks 16 which are aligned with the tools in accordance with the present invention. In the illustrated system, the finishing stations 12*a* have four tools of the fixed diameter abrasion type controlled by controller 22 to remove a fixed amount of stock from four aligned cylinder bores.

Base recesses 88 accommodate the linear locator 50 and a rotary tilt mechanism 90.

The linear locator 50 and rotary tilt mechanism 90 are configured to serve as a universal fixture for locating both in-line cylinder engine blocks and V type engine blocks (either 60 or 90 degree) in position for finishing stock from the cylinder bore walls.

Figure 7:
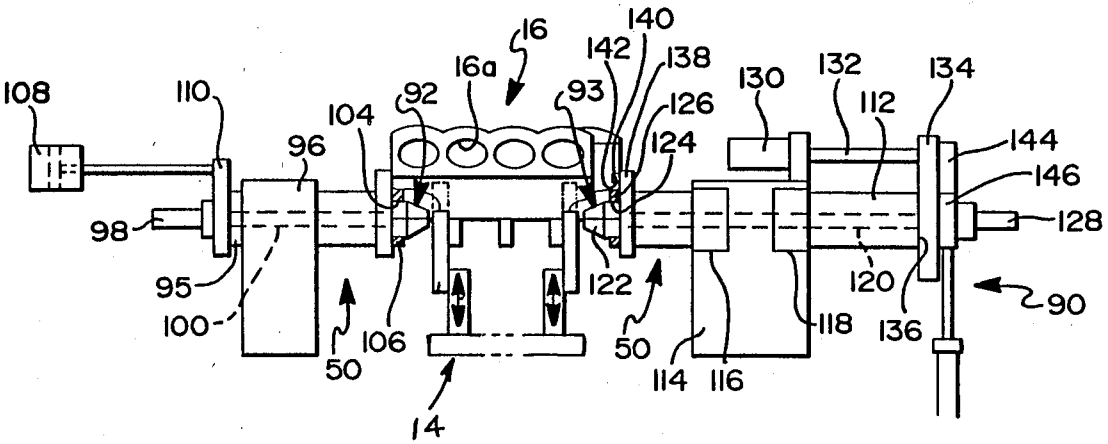
FIG. 7 is a front elevational view taken along the line 7—7 of FIG. 6 looking in the direction of the arrows.
Figure 10:
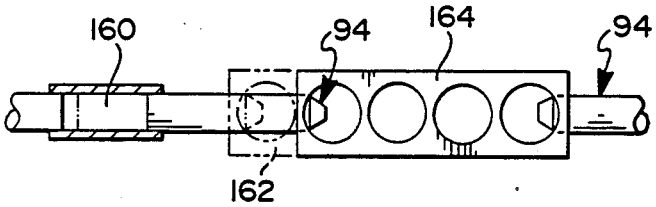
FIG.10 is a fragmentary view of another embodiment of the present invention including an adjustable length linear locator.

As best seen in FIG. 7, the linear locator 50 includes slide members comprised of a pair of expanding collets 92, 93. In the embodiment of FIG. 10, the linear locator slide member is in the form of a fixed diameter mandrel 94.

Figure 8:
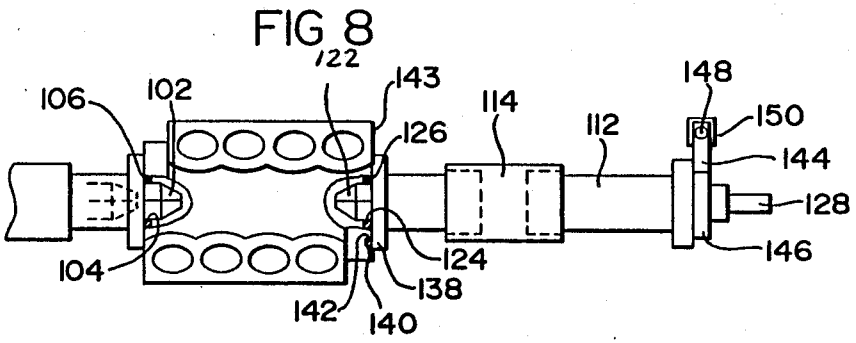
FIG. 8 is a top elevational view taken along the line 8—8 of FIG. 7 looking in the direction of the arrows.

The expanding collet 92 has a housing 95 slideably supported on a frame 96 and includes a hydraulic cylinder 98 for operating a draw bar 100 and tapered cam 101 to radially expand tapered nose segments 102 with respect to return spring 103 of the expanding collet 92. When the nose segments 102 are contracted, as shown in FIG. 9, they are free to be moved between engaged and retracted positions with respect to a crankshaft bearing bore 104 formed through an end surface 106. An advance cylinder 108 connects to a arm 110 on the housing 95 for moving the expanding collet 92 from its engaged position shown in solid line in FIG. 8 and to a retracted position shown in broken line therein.

The expanding collet 93 is located in a base recess 88 in an upright frame opposite to that which houses expanding collet 92. It includes a housing 112 which is slideably mounted in a frame 114 at spaced bearings 116, 118 therein.

A draw bar 120 is provided to radially position nose segments 122 into and out of interlocking engagement with a crankshaft bearing bore 124 in the end wall 126 of block 16. The draw bar 120 is positioned by a hydraulic cylinder 128. The housing 112 is moved between engaged and retracted positions as in the case of housing 95 by means of an advance cylinder 130. The advance cylinder 130 has its rod 132 connected to an arm 134 secured to the housing 112 at the outboard end 136 thereof.

A locate arm 138 is secured to the inboard end of the housing 112. It includes a pin 140 thereon that is engageable with locator hole 142 formed in the outer surface 143 of end wall 126. In the illustrated arrangement, the hole 142 is engaged by the pin 140 to establish a desired position of a block 16 so that either in-line block cylinders or cylinders of a V block will be vertically aligned with the illustrated finishing tools 84. A V block is shown in the illustrated case. However, in FIG. 6, a broken outline of an in-line block is also shown by reference numeral 145 to illustrate its position when engaged by the linear locator 50.

A rotate arm 144 is secured to an extension 146 on the housing 112 at the outboard end 136 thereof. The rotate arm 144 is disposed angularly with respect to the locate arm 138. The distal end of arm 144 is pivotably connected by pin 147 to one end of a rod 148 of a floating rotate cylinder 150.

Operation of the system includes selecting a desired program of operation for a particular inline or V engine block type. The engine blocks are placed on the load station 66 and the lift and carry mechanism 14 is driven to align the selected engine blocks at selected ones of the finishing stations 12 by following one of the paths 70, 72, previously discussed. When the engine block 16 is raised and carried to a given finishing station 12, the linear locator 50 is moved from its retracted position to an engaged position which references the block from its end walls with respect to the finishing tools 46.

A selected program will condition the rotate cylinder 150 to either tilt or hold the block in a position established by the expanding collets 92, 93 and the locator pin 138.

Figure 14:
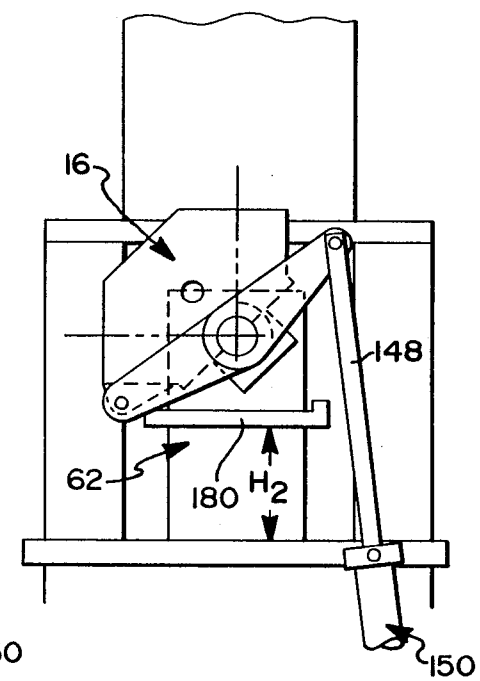
FIG. 14 is a view like FIG. 6 showing a second V block finishing position for finishing.

If the programmed operation is for a V-8 block configuration, the following sequence occurs at the first finishing station **12*a*. The rotate cylinder 150 is conditioned to push the rod 148 up, as shown in FIG. 14. The surface 152 of the V block 16 is rotated into a position where the bank of cylinder bores 16*a* therein will be aligned with two of the finishing tools which are programmed to be driven to remove stock from bores 16*a***.

Figure 13:
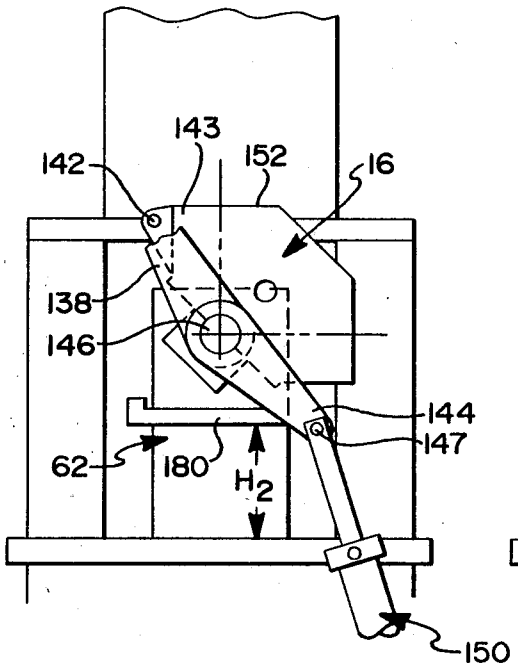
FIG. 13 is a view like FIG. 6 showing a first V block finishing position.

The V-8 block then is transferred to the following station **12*a* which is controlled by the machine program to finish the two other cylinder bores of the block 16. The rotate cylinder 150 is conditioned to pull the rod down as shown in FIG. 13. This rotates the block 16 to align surface 154 with the finishing tools 46*c*, 46*d* at the following station 12*a***.

The heads for each station 12 are off set such that the finishing tools **46*a*, 46*b* will finish first and third cylinder bores on one bank and tools 46*c*, 46*d*** will finish second and fourth cylinder bores on another bank.

Like manipulation of the block 16 is carried out at following honing stations **12*b*, 12*c*** to crosshatch finish the cylinder bores in a like manner.

Unillustrated downstream finishing stations provide like stock removal and crosshatch finishing of the second and fourth cylinder bores of the one bank and of the first and third cylinder bores of another bank.

If the programmed operation is for in-line four cylinder engine blocks the cylinder 150 will be deactivated and the cylinder bores of the block 16 will be held in a desired vertical alignment with the finishing tools.

In the embodiment of FIG. 10, the fixed diameter mandrel 94 includes an adjustable coupling 160 which will expand the length of the mandrel 94 to accommodate different length blocks 162, 164.

Figure 11:
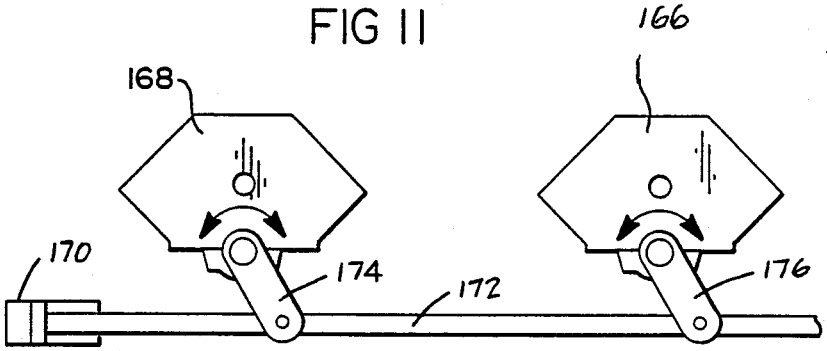
FIG. 11 is a diagrammatic view of a rotating means for a plurality of blocks driven by a single drive cylinder.

In the embodiment of FIG. 11, a series of positioned blocks 166, 168 are tilted by a common drive cylinder 170 through a bar 172 and individual links 174, 176. The cylinder 174 will tilt the blocks 166, 168 about fixed axes defined by fixed diameter mandrels coupled thereto.

Figure 12:
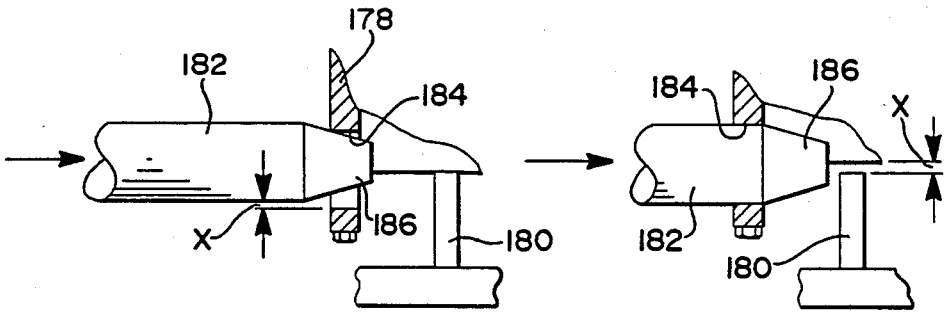
FIG. 12 is a view showing a V block lift-off finishing position.

In FIG. 12, a piloting action of the linear locator 50 is shown wherein a block 78 is lifted off a transfer cradle 180 of the lift and carry transfer 14 by locating the axis of a fixed diameter mandrel 182 (or equivalent locator pin) off line with crankshaft bearing bores 184 by a distance X which will raise the block as the mandrel 180 enters the bore. The mandrel 182 has a tapered nose 186 to provide a suitable pilot action.

Figure 6:
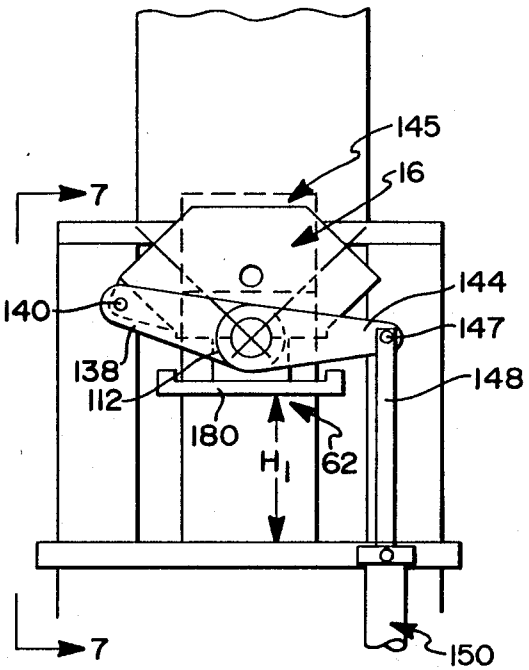
FIG. 6 is a fragmentary side elevational view taken along the line 6—6 of FIG. 5 looking in the direction of the arrows.

In order to maintain the desired lift off and tilt movement of a block 16, the lift mechanism 62 has its stroke length controlled as shown in FIGS. 6, 13 and 14 to position the transfer cradle 180 at different heights, $H_1$, $H_2$. This allows the block 16 to clear the transfer cradle 180 as it is tilted into its various positions.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

What is claimed is:

1. In cylinder block finishing apparatus having a series of aligned finishing stations located at spaced points along the transfer line and each of the finishing stations having a servo head for operating a finishing tool and control means for signaling the servo head to selectively position a finishing tool with respect to cylinder bores and to operate the finishing tool within the cylinder bores to remove predetermined stock from the bores the improvement comprising:

means defining a transfer line for carrying a plurality of engine blocks and for moving each of the engine blocks along a predetermined linear path relative to a plurality of finishing stations each having a servo head driven finishing tool;

positioning means located at each of the plurality of finishing stations for positioning an engine block with respect to said finishing tools to align it with the cylinder bores of the engine block operatively positioned at a given one of the plurality of finishing stations;

said positioning means including linear locator means directed transversely of the predetermined linear path for positioning each of a plurality of engine block types in alignment with the finishing tools when the transfer line has positioned an engine block with respect to a selected one of the finishing stations;

said linear locator means having a retracted position to clear said transfer line during movement of the engine blocks along said transfer line for movement with respect to said finishing stations and said linear locator means having an extended position for engagement with an engine block when said transfer line is at rest with respect to said finishing stations;

rotating means located at each of said finishing stations for selectively positioning the engine blocks in accordance with the engine block type presented to each of the finishing stations by the transfer line; and said control means including means for controlling the operation of the finishing tools at each of the finishing stations to correspond to the positioning of the engine block produced by said rotating means.

2. In the combination of claim 1, said linear locator means including a slide member adapted to selectively engage end bores of the selected engine block.

3. In the combination of claim 2, said slide member being an expanding collet.

4. In the combination of claim 2, said slide member being a fixed diameter mandrel defining a pivot point for moving the selected engine block into selected positions.

5. In the combination of claim 2, means connected to said slide member for extending the slide member to accommodate different length blocks.

6. In the combination of claim 1, means for locating the finishing tools on a substantially vertical finishing axis, said rotating means including means for holding engine blocks in a first position to concentrically align cylinder bores of in-line cylinder blocks with the finishing tools and further including means for tilting engine blocks to other positions to concentrically align cylinder bores of V type engine blocks with the finishing tools.

7. In the combination of claim 2, means for locating the finishing tools on a substantially vertical finishing axis, said rotating means including means for tilting engine blocks to a first position to concentrically align cylinder bores of in-line cylinder blocks with the vertical finishing axis, and for tilting engine blocks to other positions to concentrically align cylinder bores of a multiplicity of types of V engine blocks with the vertical finishing axes;

said control means including means for selectively controlling vertical stroking movement of the finishing tools to correspond to the cylinder bores aligned therewith.

8. In cylinder block finishing apparatus having a transfer line and a series of aligned finishing stations located at spaced points along the transfer line and each of the finishing stations having a servo head for operating a finishing tool and control means for signaling the servo head to selectively position a finishing tool with respect to cylinder bores and to operate the finishing tool within the cylinder bores to remove predetermined stock from the bores the improvement comprising:

linear locator means engageable with crankshaft bores of an engine block for positioning each of a plurality of engine block types in alignment with the finishing tools when the transfer line has positioned an engine block with respect to a selected one of the finishing stations;

rotating means located at each of said finishing stations for selectively positioning the engine block types in accordance with the engine block type presented to each of the finishing stations by the transfer line;

said means including means for controlling the operation of the finishing tools at each of the finishing stations to correspond to the positioning of the engine block produced by said rotating means;

an advance cylinder for retracting and extending said linear locating means;

an arm connected to said linear locator means and axially moveable therewith;

said arm having one end extending outwardly; and coacting means on said one end of said arm and on one end of a positioned block for connecting the block and said rotating means during positioning movement thereof.

9. In the combination of claim 8, said coacting means including a pin on said one end of said arm and a locate hole formed in the end wall of the positioned block.

10. In cylinder block finishing apparatus having a transfer line and a series of aligned finishing stations located at spaced points along the transfer line and each of the finishing stations having a servo head for operating a finishing tool and control means for signaling the servo head to selectively position a finishing tool with respect to cylinder bores and to operate the finishing tool within the cylinder bores to remove predetermined stock from the bores the improvement comprising:

linear locator means engageable with crankshaft bores of an engine block for positioning each of a plurality of engine block types in alignment with the finishing tools when the transfer line has positioned an engine block with respect to a selected one of the finishing stations;

rotating means located at each of said finishing stations for selectively positioning the engine block types in accordance with the engine block type presented to each of the finishing stations by the transfer line;

control means for controlling the operation of the finishing tools at each of the finishing stations to correspond to the positioning of the engine block produced by said rotating means;

said linear locator means including a slide member adapted to selectively engage end bores of the selected engine block;

means for locating the finishing tools on a substantially vertical finishing axis, said rotating means including means for tilting engine blocks to a first position to concentrically align cylinder bores of in-line cylinder blocks with the vertical finishing axis, and for tilting engine blocks to other positions to concentrically align cylinder bores of a multiplicity of types of V engine blocks with the vertical finishing axes;

said control means including means for selectively controlling vertical stroking movement of the finishing tools to correspond to the cylinder bores aligned therewith;

an advance cylinder for retracting and extending said linear locating means;

an arm connected to said linear locator means and axially moveable therewith;

said arm having one end extending outwardly;

coacting means on said one end of said arm and on one end of a positioned block for connecting the block and said rotating means during positioning movement thereof.

11. In the combination of claim 10, coacting means formed on said arm member and on a positioned block for connecting the block and said rotating means during tilting movement thereof.

12. In the combination of claim 11, said coacting means including a pin on said arm and a locate hole formed in the end wall of the positioned block.

13. In cylinder block finishing apparatus for finishing a plurality of engine block types, the apparatus having a spindle drive for a servo head driven finishing tool and controls for operating the spindle drive to selectively position finishing tools and operate them within a cylinder bore to remove predetermined stock from the cylinder bore, the improvement comprising:

means defining a transfer line for carrying a plurality of engine blocks and for moving each of the engine blocks along a predetermined linear path relative to a plurality of finishing stations each having a servo head driven finishing tool;

positioning means located at each of the plurality of finishing stations for positioning an engine block with respect to said finishing tools to align them with the cylinder bores of the engine block operatively positioned at a given one of the plurality of finishing stations;

said positioning means including linear locator means directed transversely of the predetermined linear path for positioning each of a plurality of engine block types in alignment with the finishing tools when the transfer line has positioned an engine block with respect to a selected one of the finishing stations; and rotating means for selectively tilting the engine block types in accordance with the engine block type aligned with each of the finishing tools.

14. In the combination of claim 13, a pair of upright frames and a base;

a finishing tool mounted on said frames for reciprocation thereon;

drive means for driving said finishing tool with respect to said frames;

and housing means in said base thereof housing said linear locator means and said rotating means.

15. In the combination of claim 14, drive means in each of said housing means for operating each of said linear locating means between extended and retracted positions respectively for positioning a block with respect to finishing tools and for releasing a block for transport from the block finishing apparatus; and a rotary drive means located adjacent to only one of said upright frames to tilt a selected block type with respect to the finishing tools.

16. In the combination of claim 13, said linear locator means including a slide member adapted to selectively engage end bores of the selected engine block.

17. In the combination of claim 13, means for locating the finishing tools on a substantially vertical finishing axes, said rotating means including means for positioning engine blocks to a first position to concentrically align cylinder bores of in-line blocks with said axes and for tilting engine blocks to other positions to concentrically align cylinder bores in a multiplicity of V block types with the vertical finishing axes;

and control means including means for selectively controlling the vertical stroking movement of the finishing tools to correspond to the cylinder bores aligned therewith.

18. In cylinder block finishing apparatus having a spindle drive for a finishing tool and controls for operating the spindle drive to selectively position finishing tools and operate them within a cylinder bore to remove predetermined stock from the cylinder bore, the improvement comprising:

linear locator means engageable with an engine block crankshaft bore for positioning each of a plurality of engine block types into alignment with the finishing tools;

rotating means for selectively tilting the engine block types in accordance with the engine block type aligned with the finishing tool;

an advance cylinder for retracting and extending said linear locator means;

said rotating means including an arm member having one end connected to said linear locator means and moveable therewith into engagement with a block.

19. In the combination of claim 18, coacting means formed on one end of said arm member and on a block for connecting the block and said rotating means during tilting movement thereof.

20. In the combination of claim 19, said coacting means including a pin on said one end of said member engageable with a locate hole formed in the end wall of the positioned block.

21. In the combination of claim 16, means associated with said slide member to adjust the length thereof to accommodate different length blocks.

22. In the combination of claim 1, lift and carry transfer means including transfer bar means for carrying an engine block to a position wherein its crankshaft axis is located vertically below and parallel to an elevated axis; said transfer means including lift means for raising said block to set it in position; and said linear locator means including pilot means engageable with engine block crankshaft bores to align said crankshaft axis with said elevated axis while raising said block from a transfer bar.

23. In the combination of claim 13, lift and carry transfer means including transfer bar means for carrying an engine block to a position wherein its crankshaft axis is located vertically below and parallel to an elevated axis; said transfer means including lift means for raising said block to set it in position; and said linear locator member including means engageable with engine block crankshaft bores to align said crankshaft axis with said elevated axis while raising said block from a transfer bar.

24. In the combination of claim 22, said pilot means including a slide member having an axis offset with respect to the crankshaft bores to produce lift off of a block by the amount of said offset.

25. In the combination of claim 23, said pilot means including a slide member having an axis offset with respect to the crankshaft bores to produce lift off of a block by the amount of said offset.

* * * * *